United States Patent [19]

Dougherty

[11] 4,391,540

[45] Jul. 5, 1983

[54] WITHIN-LINE COLOR CHANGE PRINTING

[75] Inventor: Edward C. Dougherty, Dracut, Mass.

[73] Assignee: Centronics Data Computer Corporation, Hudson, N.H.

[21] Appl. No.: 249,483

[22] Filed: Mar. 31, 1981

[51] Int. Cl.[3] ..... B41J 35/14; B41J 35/16

[52] U.S. Cl. ..... 400/212; 400/216.1

[58] Field of Search ..... 400/212, 216.1, 216.2, 400/216.5, 229

[56] References Cited

U.S. PATENT DOCUMENTS

| | | | |
|---|---|---|---|
| 629,438 | 7/1899 | Fay | 400/217 |
| 818,745 | 4/1906 | Cooke | 400/217 X |
| 1,961,455 | 6/1934 | Robinson | 400/217 |
| 4,022,313 | 5/1977 | Lau et al. | 400/213.1 |
| 4,033,446 | 7/1977 | Taubert | 400/212 |
| 4,073,371 | 2/1978 | Prager | 400/216.2 |
| 4,088,218 | 5/1978 | Depew | 400/212 X |
| 4,111,293 | 9/1978 | Kockler et al. | 400/213 X |
| 4,236,839 | 12/1980 | Mueller | 400/216.1 |
| 4,280,767 | 7/1981 | Heath | 400/213 X |

FOREIGN PATENT DOCUMENTS

| | | | |
|---|---|---|---|
| 2045849 | 5/1972 | Fed. Rep. of Germany | 400/212 |
| 2306083 | 10/1976 | France | 400/212 |

*Primary Examiner*—Paul T. Sewell

*Attorney, Agent, or Firm*—Kenway & Jenney

[57] ABSTRACT

In the printer disclosed herein, shifting of a multi-color ribbon carried on a movable carriage is effected by differentially adjusting the free length of a cable extending parallel to the carriage motion. The cable passes over at least a pair of pulleys on the carriage, at least one of the pulleys being movable with respect to the other in response to changes in the free length of the cable. Solenoids are provided at each end of the cable for controllably changing the free length of the cable, the amount of change being different for the two solenoids so that four different combinations of free length are available. A ribbon shifting mechanism is coupled to the movable pulley so that the multi-color ribbon is shifted in accordance with the free length of the cable.

8 Claims, 4 Drawing Figures

WITHIN-LINE COLOR CHANGE PRINTING

BACKGROUND OF THE INVENTION

The present invention relates to multi-color printing and more particularly to a ribbon shifting mechanism which can be utilized with a printer of the type in which a printhead, together with a multi-color ribbon, is traversed along a paper-supporting platen.

Multi-color printing utilizing multi-color ribbons is, of course, not new per se. Two-color ribbons are quite typically utilized in ordinary typewriters and, increasingly, multi-color capability is being introduced into high speed computer data printers. Examples of the latter are illustrated in U.S. Pat. Nos. 4,073,371; 4,088,218; 4,111,293; and 4,236,839. A need has been perceived, however, for an improved method of color changing for use in printers of the type in which a printhead, together with its ribbon, is traversed along a paper-supporting platen. In particular, a need was felt to generate ribbon shifting motions within the carriage, independent of its position. In particular, it was desired that the color changing operation occurs as rapidly as possible so that color could be changed within a line, with as little delay as possible. In most prior art multicolor printers actually reaching the marketplace color changing was typically accomplished only at the ends of the line.

Among the several objects of the present invention may be noted the provision of a moving printhead type of printer utilizing a multi-color ribbon; the provision of such a printer in which color may be changed within a line; the provision of such a printer in which motion is coupled into a moving printhead carriage independent of the carriage position; the provision of such a printer which will change colors quite rapidly; the provision of such a printer which is highly reliable and which is of relatively simple and inexpensive construction. Other objects and features will be in part apparent and in part pointed out hereinafter.

SUMMARY OF THE INVENTION

Briefly, printers constructed in accordance with the present invention are of the type in which the carriage carrying a printhead is traversed along a paper-supporting platen and characters are formed by driving a printing element against an inked ribbon interposed between the printhead and the paper. The ribbon is shifted to bring different colored portions into alignment with the printhead by a mechanism including a cable extending generally from one end of the platen to the other. The cable passes over a pair of pulleys mounted on the carriage so at least one of the pulleys is movable with respect to the other as a function of the free length of the cable. Electromagnetically controlled attachment means are provided at each end of the cable. Each attachment means has a first state and a second state, a change between states providing a corresponding, predetermined change in the free length of the cable. The respective changes in the free length are different for the two attachment means so that four different free length values are obtainable. The movable pulley on the carriage is coupled to the ribbon positioning means so that the position of the ribbon can be varied by controlling the free length of the cable through selective energization of the electromagnetically controlled attachment means.

BRIEF DESCRIPTION OF THE DRAWINGS

Corresponding reference characters indicate corresponding parts throughout the several view of the drawings.

DESCRIPTION OF THE PREFERRED EMBODIMENT

Figure 1:
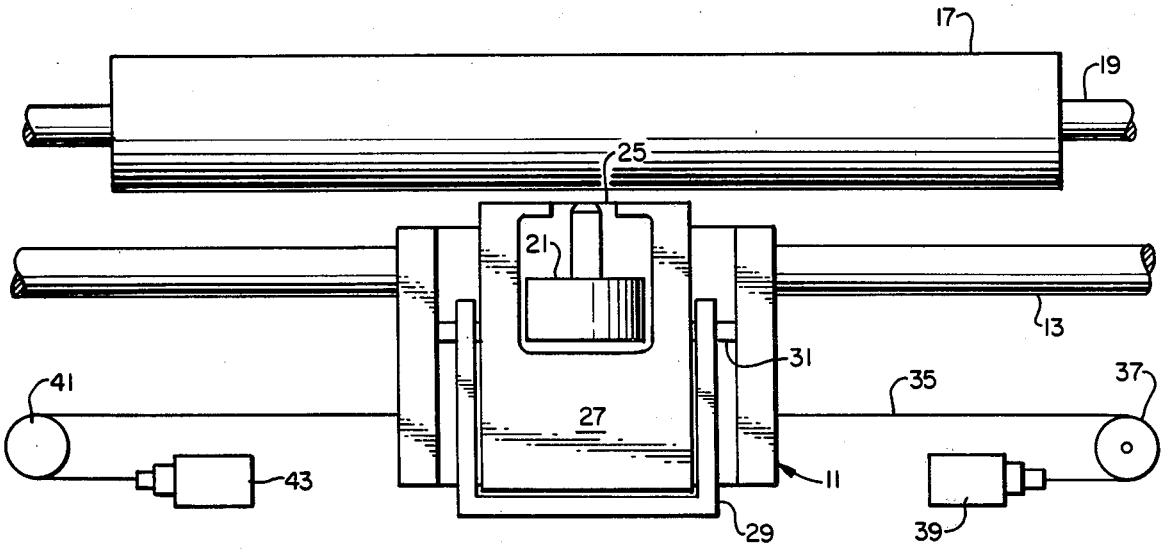
FIG. 1 is a plan view of a printer mechanism constructed in accordance with the present invention.
Figure 2:
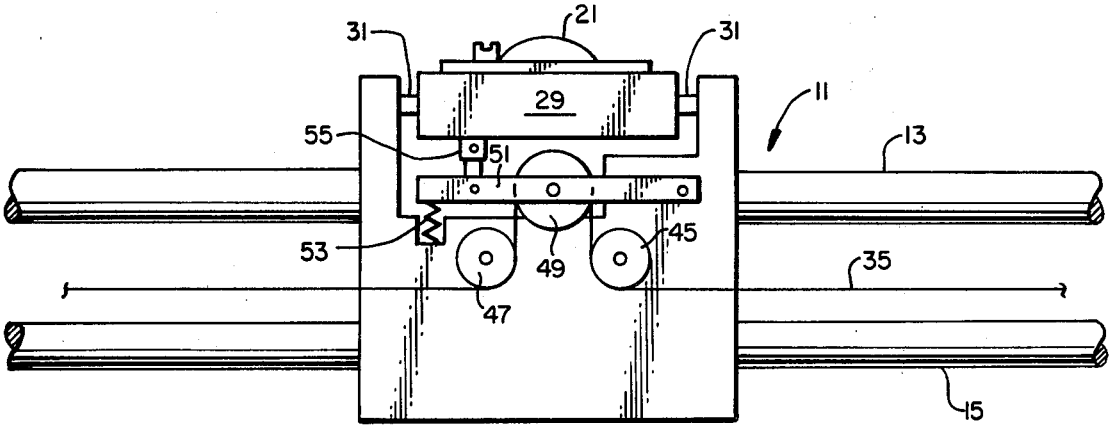
FIG. 2 is a view of the back of the carriage employed in the printer of FIG. 1.

Referring now to FIGS. 1 and 2, reference character 11 indicates generally a carriage assembly which is traversable along a platen 17 on guide rails 13 and 15. Platen 17 is illustrated as being of the rotatable type, being journaled on a shaft 19, but it should be understood that a fixed platen might also be used. Mounted on carriage 11 is a printhead 21. The printhead illustrated is of the dot matrix type but it should be understood that other forms of printing elements might also be used.

A multi-color ribbon 25 is provided by means of a ribbon cassette 27, the operative portion of the ribbon being interposed between the printhead 21 and the platen 17. The ribbon cassette snaps into and is held by a cradle-like holder 29, the holder being journaled for a rocking motion as indicated at 31.

Paralleling the platen 17, i.e. along the direction of motion of the carriage 11, is a cable 35. After passing around a pulley 37, the right end of the cable 35 is attached to the plunger of a solenoid 39 mounted on the base (not shown) of the printer. Similarly, after passing over a pulley 41, the left hand end of cable 35 is attached to the plunger of a solenoid 43 The stops on the solenoids 39 and 43 are adjusted so that the operative throw of the solenoid 39 is twice that of the solenoid 43.

Mounted on the carriage 11 are a pair of relatively fixed pulleys 45 and 47 (FIG. 2). A third pulley 49 is mounted on a lever 51 so as to be movable with respect to the other two. As may be seen, the cable 35 passes under the pulley 45, over the pulley 49, and then under the pulley 47. Lever 51 is biased upwardly by a spring 53 so as to maintain appropriate tension in the cable 35. In this arrangement, the portion of the cable 35 to the left of the carriage is in alignment with the portion to the right of the carriage. Thus, as will be understood by those skilled in the art, traversing movement of the carriage 11 along the platen 17 will not cause any movement of the movable pulley 49 with respect to the relatively fixed pulleys 45 and 47. On the other hand, any change in the free length of the cable 35, e.g. caused by energization of one or the other of the solenoids 39 and 47, will cause a corresponding vertical movement of the pulley 49 essentially independent of the position of the carriage A link 55 connects the lever 51 to the back of the cassett holder 29. Accordingly, it can be seen that motion of the lever 51 is coupled to the ribbon cassette causing it to rock around the pivots 31. The ribbon 25 is a conventional striped ribbon, i.e. comprising four parallel stripes of different color. It will thus be understood, that by controlling the rocking movemen of the cassette holder 29, different ones of the colored stripes may be brought into alignment with the printing elements in head 21.

As indicated previously, the throw of the solenoid 39 is preferably twice that of the solenoid 43. This allows a convenient binary decoding of the movements to allow four different colors to be accessed in the following manner. If neither solenoid is energized, the pulley 49 is in its highest position. If the solenoid 43 is energized alone, the pulley 49 will be in a slightly lower position. If, on the other hand, the solenoid 39 is energized alone, the pulley 49 will be brought into a somewhat lower position. Finally, if both solenoids are energized simultaneously, the pulley 49 will be brought into a last or fourth position. Thus, four separate colors may be accessed using this technique, even though the control elements, the solenoids 39 and 43, need respond only to simple on/off or binary control signals.

A clear advantage of this construction is that the electromagnetic mechanisms which effect color changing, i.e., the solenoids, are not themselves mounted on the carriage and thus do not increase the mass of the carriage nor require additional flexible wiring to extend thereto. Rather, the parts moving with the carriage can be of relatively low mass so that relatively high speed operation can be obtained. Similarly, since the control is basically digital, high reliability of the control circuitry can be expected since an effective digital-to-analog conversion is performed mechanically by the differential control of the free length of the control cable by the solenoids at either end.

Figure 3:
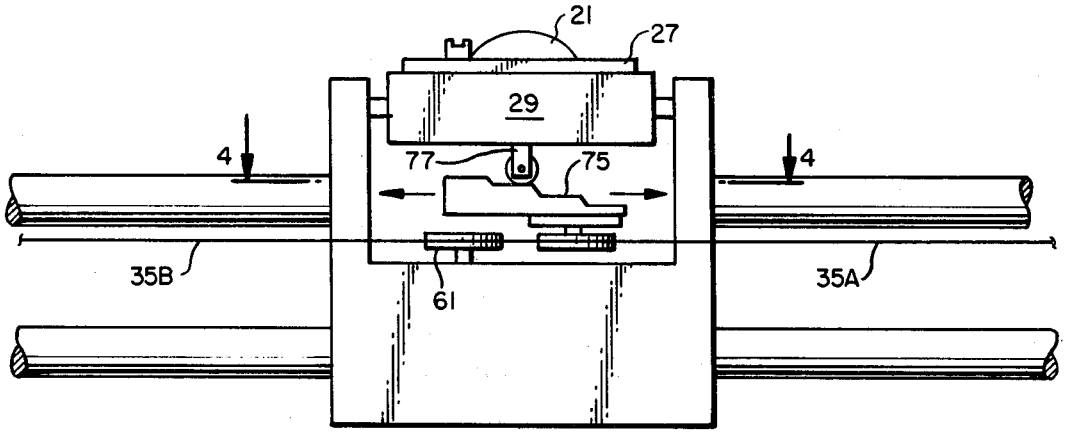
FIG. 3 is a back view of a printer carriage employing a different embodiment of the invention.
Figure 4:
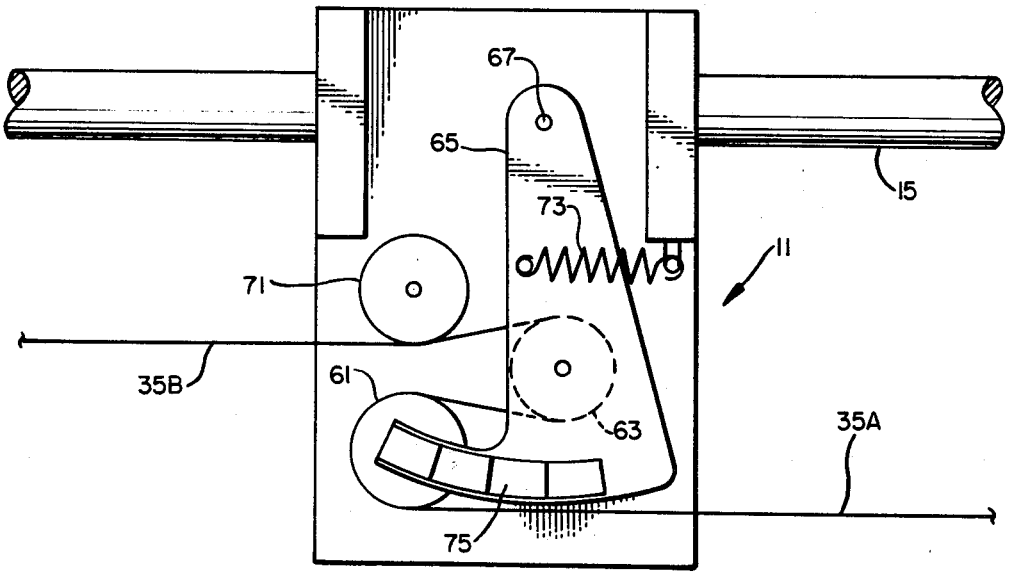
FIG. 4 is a top view, with parts broken away, of the carriage of FIG. 3, taken substantially on the line 4—4 in FIG. 3.

In the embodiments illustrated in FIGS. 1 and 2, the cable 35 was turned upwardly within the carriage assembly to directly obtain a vertical component of motion appropriate for rocking the ribbon cassette. In the alternate embodiment of FIGS. 3 and 4, the cable is kept in the same horizontal plane and a cam is used to obtain an appropriate vertical component of movement. While the portions of the control cable to the right and to the left of the carriage are at the same vertical height in this latter embodiment, they are in exact horizontal alignment. Rather, they are not parallel, being somewhat offset in a front-to-back direction as illustrated in FIG. 4.

The portion of the control cable coming from the right of the carriage is designated 35A. This portion passes first over an idler pulley 61 which is fixedly attached to the carriage 11. After leaving the idler pulley 61, the control cable passes around a relatively movable pulley 63. Pulley 63 is carried on an arm assembly 65 which is pivoted on the carriage as indicated at 67 so as to be movable in a horizontal plane. A second relatively fixed idler 71 is provided to maintain a fixed alignment of the portion of the control cable to the left of the carriage, this portion being designated by reference character 35B. Arm 65 is biased to the right by a suitable spring 73 so as to maintain the control cable under suitable tension. Though the right hand and left hand portions of the control cable are not, in this embodiment, in alignment, they are parallel to each other and to the direction of movement of the carriage 11 as it traverses the platen. Accordingly, such movement of the carriage does not generate any movement of the pulley 63 with respect to the pulleys 61 and 71. In other words movement of the carriage does not affect the free length of the cable. On the other hand, any change in the free length of the cable will affect a movement of the pulley 63 independent of the position of the carriage.

The outer end of the arm 65 carries a stepped cam surface 75. A roller follower 77 mounted on the ribbon cassette holder 29 causes the cassette to move vertically and corresponds with the horizontal movement of the cam surface 75. If desired, the cam surface may be formed and guided separately from the arm 65 to avoid vertical loading of the arm, the unified construction shown here being for the purpose of clarifying the explanation of the invention.

As with the previous embodiments, the solenoids which form the attachment points for the end of the control cable may be energized in different combinations to give four different states and consequently four different positions of the relatively movable pulley 63. By means of the cam surface 75, the four corresponding positions of the arm 65 translate into four different portions of the multi-color ribbon 25.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. In a printer of the type in which a carriage carrying a printhead is traversed on stationary guide means along a paper-supporting platen to form characters by driving a printing element against an inked ribbon interposed between the printhead and the paper, apparatus for shifting the ribbon to bring different colored portions into alignment with the printing head, said apparatus comprising:

means for effecting a change of color within a single line from at least four colors of a multi-color ribbon during carriage traverse and printing of that line entirely independent of the position of the carriage along the line including;

a cable extending generally from one end of the platen to the other;

mounted on said carriage, at least a pair of pulleys over which said cable passes, at least one of said pulleys being mounted so as to be movable with respect to the other as a function of the free length of said cable;

an electromagnetically controlled attachment means for one end of said cable having first and second states, a change between said first and second states providing a predetermined change of a first value in the free length of said cable, said attachment means being fixedly mounted with respect to said guide means;

a second electromagnetically controlled attachment means for the other end of said cable also having first and second states, a change between said first and second states of said second attachment means providing a predetermined change of a second value in the free length of said cable, said second value being different from said first value so that four different combinations of free length of said cable can be realized, said second attachment means also being fixedly mounted with respect to said guide means;

means for variably positioning to at least four positions said multi-color ribbon of at least four colors between said printing element and said platen, said multi-color ribbon being contained in a changeable cassette; and means coupling said positioning means to said movable pulley whereby the position of the ribbon with respect to the printing element can be varied independently of carriage position by controlling the states of said attachment means.

2. A printer as set forth in claim 1 wherein said ribbon is positioned at different heights to position different colored portions in alignment with said printing element.

3. A printer as set forth in claim 2 wherein a pair of pulleys are relatively fixedly mounted on said carriage and said movable pulley comprises a third pulley which is mounted for vertical movement and wherein said cable passes under each of said pair of pulleys and over said third pulley between the pair of pulleys.

4. A printer as set forth in claim 3 wherein the portion of said cable on one side of said carriage is in alignment with the portion on the other side of said carriage.

5. A printer as set forth in claim 1 wherein said movable pulley controls the position of a stepped cam and wherein said ribbon-positioning means includes a follower which controls the position of said ribbon as a function of the position of said stepped cam.

6. A printer as set forth in claim 5 wherein said pulleys are mounted in a common plane and wherein the portions of said cable on opposite sides of said carriage are parallel to each other and to the direction of movement of the carriage.

7. A printer as set forth in claim 1 wherein both of said electromagnetically controlled attachment means are solenoids and wherein the operative stroke of one of said solenoids is twice that of the other.

8. In a printer of the type in which a carriage carrying a printhead is traversed on stationary guide means along a paper-supporting platen to form characters by driving a printing element against an inked ribbon interposed between the printhead and the paper, a means for shifting the ribbon to bring different colored portions into alignment with the printing head, said shifting means comprising:

means for effecting a change of color within a single line from at least four colors of a multi-color ribbon during carriage traverse and printing of that line entirely independent of the position of the carriage along the line including;

a cable extending generally from one end of the platen to the other;

mounted on said carriage, a pair of pulleys which are fixedly journaled with respect to said carriage and a third pulley which is indirectly mounted so as to be movable with respect to the pair, the cable passing sequentially over one of the pair, the movable pulley and the other of the pair so that the position of the movable pulley is controllable as a function of the free length of the cable, the portions of the cable on opposite sides of the carriage being parallel to each other and to the direction of movement of the carriage;

an electromagnetically controlled attachment means for one end of said cable having first and second states, a change between said first and second states providing a predetermined change of a first value in the free length of said cable, said attachment means being fixedly mounted with respect to said guide means;

a second electromagnetically controlled attachment means for the other end of said cable also having first and second states, a change between said first and second states of said second attachment means providing a predetermined change of a second value in the free length of said cable, said second value being essentially twice that of said first value so that four different variations of cable free length can be effected, said second attachment means also being fixedly mounted with respect to said guide means;

means for variably positioning a multi-color ribbon of at least four colors between said printing element and said platen; and means coupling said positioning means to said movable pulley whereby the position of the ribbon with respect to the printing element can be varied independently of carriage position by controlling the states of said attachment means.

* * * * *